United States Patent [19]

Slavinsky et al.

[11] 4,229,946

[45] Oct. 28, 1980

[54] PLANT FOR COLLECTING AND BRIQUETTING DOMESTIC WASTE

[76] Inventors: Valentin N. Slavinsky, prospekt Shvernika, 10, kv. 101; Genrikh V. Bairon, Kolpino, ulitsa Proletarskaya, 131, kv. 77, both of Leningrad; Adolf M. Alexandrov, Federativny prospekt, 6, korpus 3, kv. 8, Moscow; Gennady M. Alexeev, Sredny prospekt, 61, kv. 55, Leningrad; Vladimir M. Matveev, Staro-Orlovskaya, ulitsa, 35, kv. 1, Leningrad; Oleg D. Minin, ulitsa Basseinaya, 105, korpus 1, kv. 355, Leningrad; Jury A. Tsimbler, Sojuzny prospekt, 10, kv. 26, Moscow; Vladimir A. Vasiliev, Moskovsky prospekt, 125, kv. 40; Gennady B. Provalsky, ulitsa Gastello, 10, kv. 31, both of Leningrad, all of U.S.S.R.

[21] Appl. No.: 958,265

[22] Filed: Nov. 6, 1978

[51] Int. Cl.[2] ..... F25C 5/14

[52] U.S. Cl. ..... 62/341; 100/49; 100/DIG. 3

[58] Field of Search ..... 100/251, 145, 49, 45, 100/256, 147–150, DIG. 3; 62/341

[56] References Cited

U.S. PATENT DOCUMENTS

| | | | |
|---|---|---|---|
| 2,541,742 | 2/1951 | Booth | 100/145 X |
| 3,514,969 | 6/1970 | Harza | 62/341 |
| 3,650,120 | 3/1972 | Harza | 62/341 X |
| 3,651,755 | 3/1972 | Gati | 100/145 X |
| 3,659,427 | 5/1972 | Harza | 62/341 X |
| 3,685,309 | 8/1972 | Harza | 62/341 X |
| 3,686,889 | 8/1972 | Harza | 62/341 X |
| 4,044,569 | 8/1977 | Harza | 62/341 |
| 4,121,967 | 10/1978 | Reinhall | 100/148 X |

*Primary Examiner*—Lloyd L. King
*Assistant Examiner*—Tapolcai, Jr. William E.
*Attorney, Agent, or Firm*—Steinberg & Blake

[57] ABSTRACT

In the plant for collecting and briquetting domestic waste the housing has loading and discharge openings and coaxially accommodates therein a chamber for forming domestic waste into briquettes and a conveyer screw for compacting the domestic waste, operatively connected to a reversible drive. The chamber adjoins the screw and has mounted therein an abutment spanning the cross-sectional area of the chamber. The abutment is mounted in the chamber for motion therein under the action of the domestic waste being formed into a briquette and being advanced by the effort of the rotating conveyer screw. The chamber is operatively connected with a drive for being moved axially to release a briquette that has been formed and for being returned into the initial position.

5 Claims, 5 Drawing Figures

PLANT FOR COLLECTING AND BRIQUETTING DOMESTIC WASTE

FIELD OF INVENTION

The present invention relates to plants for collecting domestic waste and for forming it into briquettes, for subsequent transportation to the place of either disposal or utilization.

It is expedient to have the disclosed plant for collecting and briquetting domestic waste installed in inner courts or yards of housing blocks of cities and residential areas, for domestic waste to be disposed thereinto and subsequently formed into briquettes.

Alternatively, it may be expedient to have such a plant installed at waste transfer or reloading stations, for forming briquettes from domestic waste arriving in a suspended state through pipes by the pneumatic transport technique from waste conduits of residential buildings, amusement areas, etc.

BACKGROUND OF INVENTION

There are known plants for collecting and briquetting waste, comprising a housing with loading and discharge openings, coaxially accommodating therein a chamber for forming waste into briquettes and a waste-compacting mechanism.

The waste-compacting mechanism in the known plants is a plunger-type press providing for three-dimensional compression of waste having generally homogeneous structure.

Such three-dimensional or volumous compression of waste would not ensure sufficiently strong bonds between its component fragments and particles, and, hence, the briquettes obtained are not sufficiently strong for facilitated subsequent handling and transportation.

It is an object of the present invention to create a plant for collecting and briquetting domestic waste, wherein the mechanism for compacting domestic waste should be of a construction enabling to obtain a relatively strong briquette from fractions and fragments of domestic waste, widely differing by size and structure.

It is another object of the present invention to provide for obtaining formed briquettes of an optimally great weight.

With these and other objects in view there is disclosed a plant for collecting and briquetting domestic waste, comprising a housing having a loading opening and a discharge one, the housing accommodating therein coaxially a chamber for forming domestic waste into a briquette and a mechanism for compacting domestic waste, in which plant, in accordance with the invention, the mechanism for compacting domestic waste includes a conveyer screw operatively connected with a reversible drive, the chamber adjoining the screw and having mounted therein an abutment member spanning the cross-sectional area of the chamber and movable therein under the action of the domestic waste being formed into a briquette and being moved by the rotation of the screw, the chamber being operatively connected with a drive for being moved axially to release a briquette that has been formed and for being returned into the initial position.

It is expedient to make the conveyer screw in the form of a helical strip operatively connected with the reversible drive through a sleeve to the internal surface of which the helical strip is attached by the lateral surface thereof.

With the conveyer screw being in this form, there is effected twisting and rubbing of the fractions and fragments of domestic waste, which enhances its being formed into a strong briquette.

It is not less expedient that the chamber for forming domestic waste into briquettes should have mounted thereon a briquette-freezing arrangement comprising an evaporator and a refrigerating unit, rigidly coupled with each other.

It is not less expedient that the abutment member should include a disc spanning the cross-sectional area of the chamber, journalled with aid of a bearing on one end of a screw having its other end cooperating with a nut mounted on the chamber.

This structure of the abutment member is both simple and reliable in operation.

A plant for collecting and briquetting domestic waste, constructed in accordance with the invention, ensures that domestic waste being compacted has its components bonded together, whereby it is possible to obtain a relatively strong self-substaining briquette of an optimally great weight from all kinds of domestic waste widely differing by the structure and the size of its components, provided this component or fragment size is short of that of the loading opening of the plant.

BRIEF DESCRIPTION OF DRAWINGS

The invention will be further described in connection with an embodiment thereof, with reference to the accompanying drawings, wherein.

DETAILED DESCRIPTION OF EMBODIMENT

Figure 1:
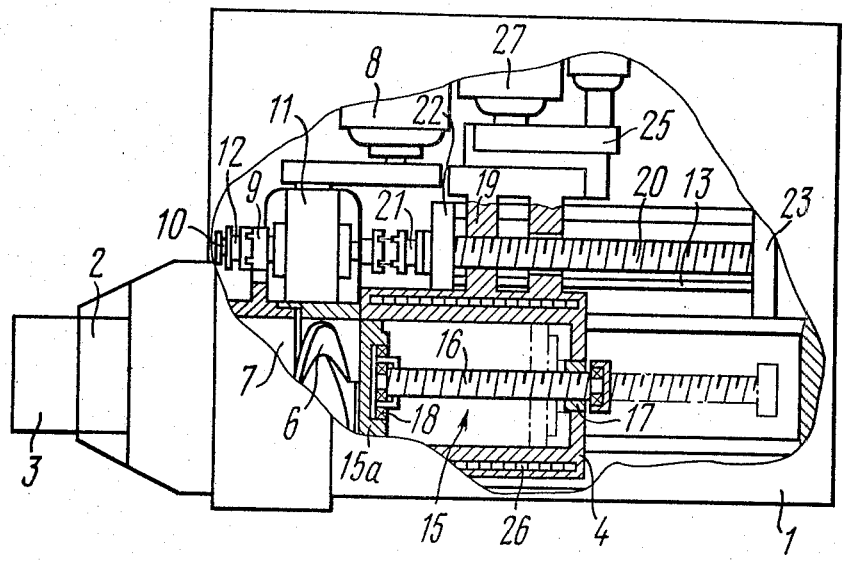
FIG. 1 is a schematic partly broken away front view of a plant for collecting and briquetting domestic waste, constructed in accordance with the invention.

The plant for collecting and briquetting domestic waste comprises a housing 1 (FIGS. 1 and 2) with a loading or charging opening 2 closeable with a lid 3. The housing 1 coaxially accommodates therein a chamber 4 for forming domestic waste into briquettes 5 (FIG. 3), and a mechanism for compacting the domestic waste loaded into the plant, in the form of a conveyer screw 6 which in the presently described preferred embodiment is made in the form of a helical strip or band, also indicated with numeral 6. Mounted in the housing 1 is a hollow sleeve 7 to the internal surface of which the helical strip 6 is rigidly attached by its lateral or side surface. The sleeve 7 is operatively connected with a reversible drive unit 8. The operative connection between the sleeve 7 and the reversible drive unit 8 includes a gear made integral with the sleeve 7, meshing with a pinion 9 mounted on the output shaft 10 of a reducer 11 coupled to the reversible drive unit or motor 8. The operative connection also includes a clutch 12 mounted on the output shaft 10 for selective engagement for rotation of the helical strip 6.

Figure 4:
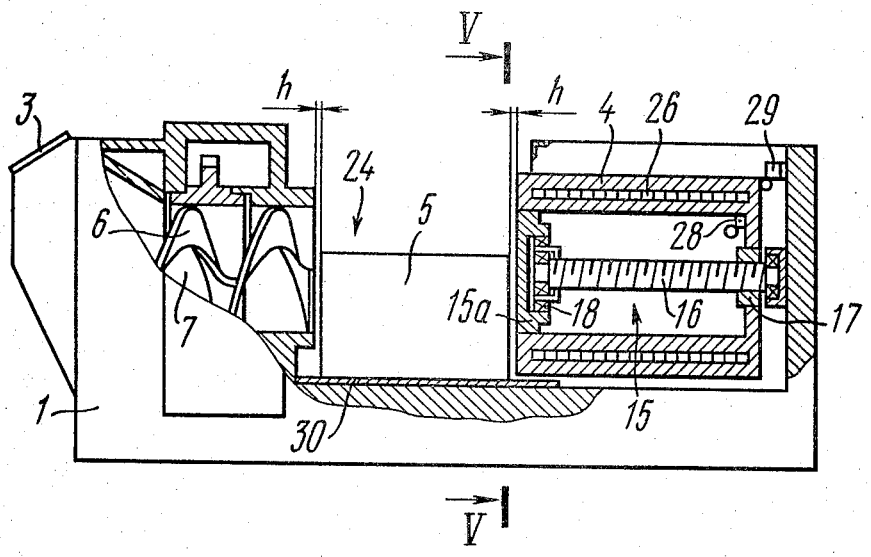
FIG. 4 is a side view of the same plant in a position illustrated in FIG. 3.
Figure 5:
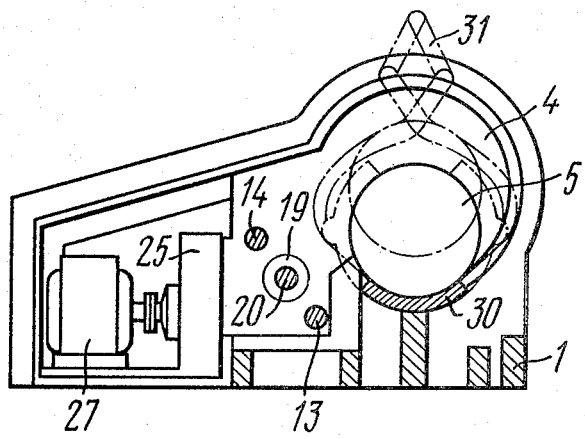
FIG. 5 is a sectional view taken on line V—V of FIG. 4.

The chamber 4 (FIG. 4) for forming domestic waste into briquettes is mounted on guideways or tracks 13 (FIG. 5) and 14 secured in the housing 1. The chamber 4 accommodates therein an abutment member 15 (FIG. 2) including a disc 15*a* spanning the cross-sectional area of the chamber 4 and a screw-nut couple made up of a screw 16 and a nut 17. The screw 16 has the disc 15*a* journalled on one its end with aid of a bearing 18, while its other end is engaged in the nut 17 secured to the chamber 4.

The chamber 4 is mounted on the guideways 13 and 14 for axial reciprocation, so that a briquette can be released upon its having been formed, which reciprocation is made possible by the chamber 4 being operatively connected to the reversible drive unit 8. This operative connection between the chamber 4 and the reversible drive unit 8 includes a nut 19 either made fast or integral with the chamber 4 and a lead screw 20 engaging the nut 19 and engageable via a clutch 21 with the shaft of the reducer 11.

The lead screw 20 has its ends journalled in bearings 22 and 23 mounted in the housing 1.

Figure 2:
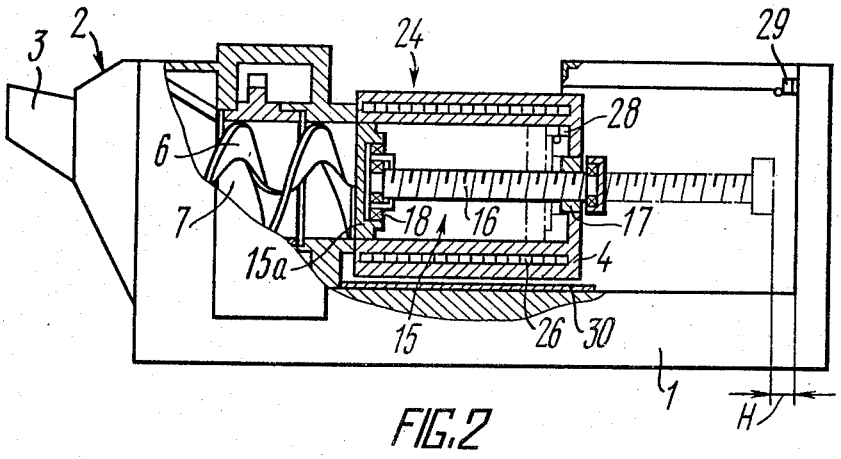
FIG. 2 shows the same in a side view.
Figure 3:
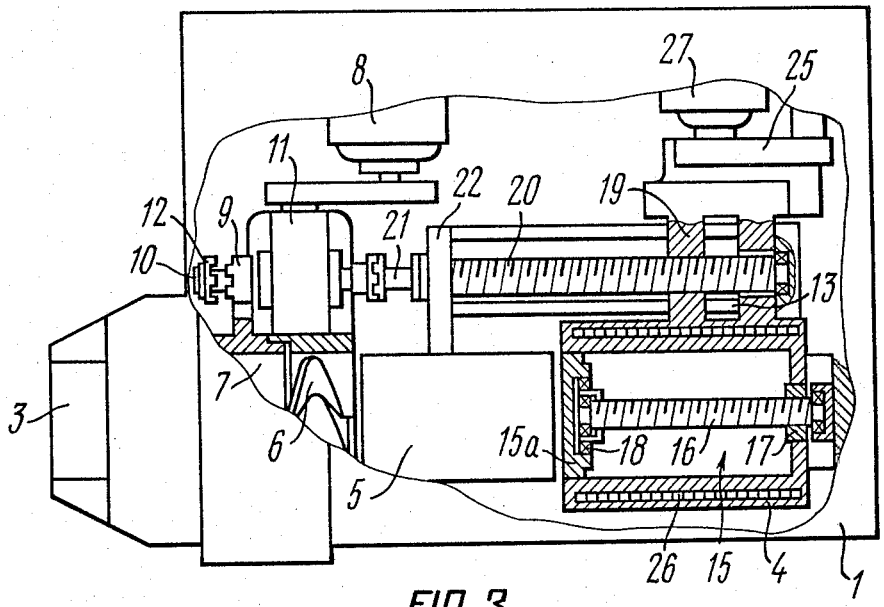
FIG. 3 shows the same viewed in plan, with the chamber displaced to release a briquette.

The housing 1 has in the upper part thereof, in the area of the location of the chamber 4, a discharge opening 24 (FIGS. 3 and 4) which is closed off by the chamber 4 when the latter is in its initial or normal position, i.e. during the briquetting operation, as it is shown in FIGS. 1 and 2.

Also mounted on the chamber 4 is an arrangement 25 (FIG. 3) for freezing a briquette 5. The freezing arrangement 25 includes an evaporator 26 and a refrigerating unit 27 rigidly coupled with each other and supported by the chamber 4.

The chamber 4 and the housing 1 have mounted thereon limit switches 28 (FIG. 2) and 29 situated to respond to the extreme right-hand positions, respectively, of the disc 15*a* and of the chamber 4.

Underlying the chamber 4 is a tray 30 (FIG. 4) secured to the housing 1 and adapted to receive a formed briquette 5.

The plant for collecting and briquetting domestic waste operates, as follows.

Domestic waste is loaded into the plant through the loading opening 2. Then the reversible drive 8 is energized to rotate the sleeve 7 via the reducer 11 and the engaged clutch 12, whereby the helical strip 6 acting as the screw conveyer is rotated. The helical strip 6 engages the domestic waste and feeds it toward the disc 15*a* of the chamber 4.

The disc 15*a* takes up the effort of the domestic waste being compressed, and upon the friction between the disc 15*a* and the bearing 18 overcoming the friction in the engagement of the screw 16 with the nut 17, the screw 16 turns in the nut 17, and thus moves to the right (in the drawing), jointly with the disc 15*a*, through a corresponding distance. In this manner the briquette 5 is formed, with the disc 15*a* successively retreating within the chamber 4. The disc 15*a* retreats until it engages the limit switch 28. Upon the disc 15*a* engaging the limit switch 28, the latter initiates a command signal sent to the drive unit 8 to reverse the rotation of the latter, whereby the rotation of the helical strip 6 is likewise reversed, so that the exposed end face of the briquette 5 is levelled out, and fallout of components or fractions of the domestic waste onto the tray 30 from the working zone of the helical strip 6 is prevented. At this moment the other end of the screw 16, opposite to that supporting the disc 15*a*, is still spaced from the housing 1 by the distance "H" equalling the sum of the gaps "h" and "$h_1$," respectively, between the end face of the briquette 5 and the end face of the helical strip 6, and between the end face of the briquette 5 and the disc 15*a*.

With the respective end face of the briquette 5 levelled out, the clutch 12 is disengaged to disconnect the sleeve 7 and the helical strip 6 from the reducer 11. Then the clutch 21 is engaged to connect the lead screw 20 to the reducer 11.

With the lead screw 20 being rotated, the nut 19 jointly with the chamber 4 is driven along this screw 20 toward the extreme right-hand (in the drawing) position, i.e. toward the engagement with the limit switch 29.

The limit switch 29 is so positioned that it is engaged by the chamber 4 with the spacing "H" between the screw 16 and the housing 1 completely taken up.

With the chamber 4 being thus displaced, the briquette 5 becomes released, and the discharge opening 24 is opened.

Once engaged, the limit switch 29 initiates a command signal sent to reverse the rotation of the drive unit 8.

The briquette 5 is now released, and falls by gravity onto the tray 30 from which it is subsequently removed, e.g. by grippers 31, to be transported to a point of destination.

Following the removal of the briquette 5 from the plant, the chamber 4 is returned into its initial or normal position by the lead screw 20 being rotated in the corresponding direction from the reversible drive unit 8 through the reducer 11 and the engaged clutch 8. The plant is thus prepared for forming the next briquette.

The particular interrelationship of the movement of the disc 15*a* and chamber 4 during operation is also seen from the above. More particularly, the disc 15*a* is mounted in the chamber 4 in a manner such that it moves from a first position (FIG. 1, solid lines) to a second position (FIG. 1, dash lines) independently of the chamber 4 and under the action of the waste products which are advanced via the rotation of the conveyer screw 6 whereupon a briquette is formed. The chamber 4 is then moved from a first position (FIG. 1) to a second position (FIG. 3) independently of the movement of the disc 15*a*, i.e., while the disc 15*a* remains stationary, so that the formed briquette can be released. The chamber 4 is then moved from its second position to the first position together with the disc 15*a* which while moving with the chamber moves from its second position to its first position.

Whenever the domestic waste being compacted into a briquette is to be frozen, simultaneously with the engagement of the helical strip 6 for work-performing rotation the arrangement 25 for freezing domenstic waste is energized, and the process of forming a briquette 5 is carried out, as it has been already described.

What is claimed is:

1. A plant for collecting and briquetting domestic waste, comprising: a housing with a loading opening and a discharge opening; a conveyer screw mounted in said housing adjacent to the loading opening thereof and adapted to advance and compact domestic waste; a reversible drive operatively connected to said conveyor screw; a chamber member for forming domestic waste into briquettes, said chamber member being mounted in said housing adjacent to the discharge opening thereof, coaxially with said conveyer screw and adjoining the latter at one of the end faces thereof; abutment means mounted in the interior of said chamber member and spanning the cross-sectional area thereof, said abutment means being mounted in said chamber member interior for axial motion therein under the action of domestic waste being formed into a briquette and which is being advanced by the rotation of said conveyer screw; said chamber member being mounted in said housing for axial reciprocation to release a briquette upon its having been formed and for being returned into the initial position; and means for effecting reciprocation of said chamber member.

2. A plant as set forth in claim 1, wherein said conveyer screw includes a helical strip, its operative connection with said reversible drive being effected through a sleeve an internal surface to which said helical strip is attached by the lateral surface thereof.

3. A plant as set forth in claim 1, wherein said chamber member for forming domestic waste into briquettes has mounted thereon an arrangement for freezing a briquette, including an evaporator and a refrigerating unit, rigidly coupled to each other.

4. A plant as set forth in claim 1, wherein said abutment means comprises a disc spanning the cross-sectional area of said chamber member and journalled with aid of bearing means on one end of a screw having its other end cooperating with a nut secured on said chamber member.

5. A plant for collecting and briquetting domestic waste, comprising: a housing with a loading opening and a discharge opening; a conveyer screw mounted in said housing adjacent to the loading opening thereof and adapted to advance and compact domestic waste; a reversible drive operatively connected to said conveyer screw; a chamber for forming domestic waste into briquettes, mounted in said housing adjacent to the discharge opening thereof, coaxially with said conveyer screw and adjoining the latter at one of the end faces thereof; abutment means mounted in said chamber and spanning the cross-sectional area thereof; said abutment means being mounted in said chamber for motion therealong from a first position to a second position independently of said chamber under the action of domestic waste being formed into a briquette and which is being advanced by the rotation of said conveyer screw; said chamber being mounted in said housing for axial reciprocation from a first position to a second position independently of said abutment means to release a briquette upon its having been formed and from said second position to said first position together with said abutment means; and means for effecting reciprocation of said chamber whereby upon said chamber moving together with said abutment means from said second position to said first position, said abutment means also moves from its second position to its first position.

* * * * *